US007950134B2

(12) United States Patent
Ho et al.

(10) Patent No.: US 7,950,134 B2
(45) Date of Patent: May 31, 2011

(54) IMPLANTABLE ANTENNA

(75) Inventors: Andy Ho, Tsuen Wan (HK); Niki Eder, Castle Hill (AU); David Walker, Lane Cove (AU); Katherine Meagher, Main Beach (AU); Peter Schuller, Turramurra (AU)

(73) Assignee: Cochlear Limited, Macquarie University, NSW ( * ) Notice: Subject to any disclaimer, the term of this patent is extended or adjusted under 35 U.S.C. 154(b) by 0 days.

(21) Appl. No.: 10/581,090

(22) PCT Filed: Dec. 8, 2004

(86) PCT No.: PCT/AU2004/001726

§ 371 (c)(1),
(2), (4) Date: Feb. 16, 2007

(87) PCT Pub. No.: WO2005/055363

PCT Pub. Date: Jun. 16, 2005

(65) Prior Publication Data

US 2007/0128940 A1 Jun. 7, 2007

(30) Foreign Application Priority Data

Dec. 8, 2003 (AU) ..... 2003906787
Sep. 16, 2004 (AU) ..... 2004905355

(51) Int. Cl.
*H01P 11/00* (2006.01)

(52) U.S. Cl. ..... 29/600; 29/592.1; 29/601; 29/605; 340/539.12

(58) Field of Classification Search ..... 29/600–601, 29/830–832, 855, 856, 605–606; 343/895, 343/700 MS, 725, 729, 850; 340/572.1–572.5, 10.33, 10.34, 539.12; 156/272.2; 607/122–128, 137; 604/104–106
See application file for complete search history.

(56) References Cited

U.S. PATENT DOCUMENTS

| | | | | |
|---|---|---|---|---|
| 1,948,875 A | | 2/1934 | Beitling | |
| 2,824,306 A | * | 2/1958 | Pfaff | 343/788 |
| 3,166,104 A | | 1/1965 | Foley, Jr. et al. | |
| 3,271,625 A | | 9/1966 | Caracciolo | |
| 3,429,788 A | | 2/1969 | Parstorfer | |
| 3,478,424 A | | 11/1969 | Meoni | |
| 3,497,947 A | | 3/1970 | Ardezzone | |
| 4,101,899 A | * | 7/1978 | Jones et al. | 343/788 |

(Continued)

FOREIGN PATENT DOCUMENTS

DE 4139440 6/1993

(Continued)

OTHER PUBLICATIONS

Derwent Abstract Accession No. 87-121639/17, SU 1256-122 A, Frunze Ty Azhelektro, Sep. 7, 1986.

(Continued)

*Primary Examiner* — Minh Trinh
(74) *Attorney, Agent, or Firm* — Kilpatrick Townsend & Stockton LLP

(57) ABSTRACT

A method of forming and connecting an antenna to a feedthrough member of a housing. The method comprising a step of: positioning the feedthrough member and an antenna template relative to each other. A step of connecting the first portion of at least one electrically conducting wire to the feedthrough member. An additional step of winding the wire at least once around the antenna template, and a further step of connecting a second portion of each wire to said feedthrough member.

23 Claims, 7 Drawing Sheets

U.S. PATENT DOCUMENTS

| | | | | |
|---|---|---|---|---|
| 4,200,971 | A | 5/1980 | Shimizu et al. | |
| 4,396,792 | A | 8/1983 | Falk | |
| 4,865,562 | A | 9/1989 | Burg et al. | |
| 5,206,495 | A * | 4/1993 | Kreft | 235/492 |
| 5,274,917 | A | 1/1994 | Corbett, III et al. | |
| 5,462,408 | A | 10/1995 | Coffy | |
| 5,596,797 | A * | 1/1997 | Bumsted | 29/601 |
| 5,779,839 | A * | 7/1998 | Tuttle et al. | 156/213 |
| 5,782,645 | A | 7/1998 | Stobie et al. | |
| 5,833,714 | A | 11/1998 | Loeb | |
| 5,907,893 | A | 6/1999 | Zadno-Azizi et al. | |
| 5,967,841 | A | 10/1999 | Bianca et al. | |
| 6,101,371 | A * | 8/2000 | Barber et al. | 455/73 |
| 6,133,072 | A | 10/2000 | Fjelstad | |
| 6,179,659 | B1 | 1/2001 | Moden | |
| 6,181,296 | B1 | 1/2001 | Kulisan et al. | |
| 6,195,858 | B1 * | 3/2001 | Ferguson et al. | 343/895 |
| 6,206,735 | B1 | 3/2001 | Zanolli | |
| 6,308,744 | B1 | 10/2001 | Becherucci et al. | |
| 6,336,269 | B1 | 1/2002 | Eldridge et al. | |
| 6,414,835 | B1 | 7/2002 | Wolf et al. | |
| 6,446,678 | B1 | 9/2002 | Becherucci et al. | |
| 6,501,437 | B1 * | 12/2002 | Gyorko et al. | 343/895 |
| 6,517,476 | B1 | 2/2003 | Bedoya et al. | |
| 6,552,655 | B2 * | 4/2003 | Barbulescu | 340/426.11 |
| 6,638,121 | B1 | 10/2003 | Walker et al. | |
| 6,704,994 | B1 * | 3/2004 | Gijs | 29/601 |
| 6,764,336 | B2 | 7/2004 | Ma et al. | |
| 6,820,314 | B2 * | 11/2004 | Ferguson et al. | 29/25.42 |
| 7,337,974 | B2 * | 3/2008 | Caruana | 235/492 |
| 7,396,265 | B2 | 7/2008 | Darley et al. | |
| 2001/0039374 | A1 | 11/2001 | Schulman | |
| 2004/0164923 | A1 | 8/2004 | Aisenbrey | |

FOREIGN PATENT DOCUMENTS

| | | | |
|---|---|---|---|
| GB | 2166005 | A | 4/1986 |
| GB | 2288028 | A | 10/1995 |
| GB | 2356935 | A | 6/2001 |
| JP | 63274074 | | 11/1988 |
| JP | 2001009841 | | 1/2001 |
| JP | 2001052780 | | 2/2001 |
| JP | 2002119435 | | 4/2002 |
| JP | 2003317892 | | 11/2003 |
| WO | 2004030159 | | 4/2004 |
| WO | 2005055363 | | 6/2005 |

OTHER PUBLICATIONS

Derwent Abstract, Accession No. 93-376433/47, SU 1775803 A1, Khark Aviation Inst, Nov. 15, 1992.

International Searching Authority, "International Search Report," issued in connection with International Patent Application No. PCT/AU2003/001288, on Oct. 31, 2003 (5 pages).

International Preliminary Examining Authority, "International Preliminary Examination Report," issued in connection with International Patent Application No. PCT/AU2003/001288, on Jan. 18, 2005 (5 pages).

International Searching Authority, "International Search Report," issued in connection with International Patent Application No. PCT/AU2004/001726, on Mar. 18, 2005 (5 pages).

International Preliminary Examining Authority, "Written Opinion," issued in connection with International Patent Application No. PCT/AU2004/001726, on Mar. 18, 2005 (5 pages).

International Preliminary Examining Authority, "International Preliminary Report on Patentability," issued in connection with International Patent Application No. PCT/AU2004/001726, on Nov. 23, 2005 (5 pages).

European Patent Office, "Supplementary European Search Report," issued in connection with European Patent Application No. 03747701.5, on Feb. 27, 2007 (3 pages).

English language translation of "Notice of Rejection," issued by the Japanese Patent Office in connection with Japanese Patent Application No. 2004-538572, on Sep. 30, 2008 (7 pages).

Petersen, Kurt E., "Silicon as a Mechanical Material," Proceedings of the IEEE, vol. 70, No. 5, May 1982 (2 pages).

Rousche et al., "Flexible Polyimide-Based Intracortical Electrode Arrays with Bioactive Capability," IEEE Transactions on Biomedical Engineering, vol. 48, No. 3, Mar. 2001 (11 pages).

Ziaie et al., "A Hermetic Glass-Silicon Micropackage with High-Density On-Chip Feedthroughs for Sensors and Actuators," Microelectromechanical Systems Journal, pp. 166-179, vol. 5, Issue 3, Sep. 1996 (15 pages).

* cited by examiner

IMPLANTABLE ANTENNA

CROSS-REFERENCE TO RELATED APPLICATIONS

The present application claims priority from Provisional Patent Application Nos 2003906787 and 2004905355 filed on 8 Dec. 2003 and 16 Sep. 2004, respectively, the contents of which are incorporated herein by reference.

FIELD OF INVENTION

The present invention relates generally to the field of forming miniature wiring and connector systems for electrical products, and more specifically, for forming miniature wiring and connective systems for a medical implant such as a cochlear implant assembly.

BACKGROUND OF THE INVENTION

In many electrical devices, particularly those that are manufactured on a very small scale, the manufacture of the wiring and connector components is often a labor intensive and specialized craft. Ensuring that the wiring and connection of the various components of the systems occurs correctly is often the most expensive and labor intensive aspect of the manufacturing process, resulting in large costs associated with the time taken to manufacture the device which is often passed on to the ultimate consumer. This is also the case when such devices need to be specifically hand-made to a specification as often he availability of the device is dependent upon the time taken to manufacture the device, with the time taken being difficult or impossible to expedite.

This is particularly the case in the field of medical implants and electrical devices that are implanted in the body to perform a specific task. Such devices may include: stimulating devices such as pacemakers, cochlear implants, FES stimulators, recording devices such as neural activity sensors and the like, implantable cables which may be used to connect implantable devices to other implantable devices or stimulating/sensing devices, diagnostic devices capable of carrying out in-vivo analysis of body parameters, and other types of implantable devices not yet contemplated. In such devices, the size needs to be minimized to ensure that they are minimally invasive upon implantation. As a result in such instances, the electronic wiring and connections need also to be relatively very small. As such, manufacturing such devices to ensure that they are reliable and sturdy is a specialized art, and requires much time and expense.

Current techniques for the manufacture of electrode arrays for cochlear implant systems, in particular, are relatively highly labor intensive. This is in the main due to the intricate nature of the array and the very small dimensions of the array necessary to allow it to be inserted in the scala tympani of the human cochlea. Being an implantable device, the method of manufacture also needs to result in a biocompatible product that is not susceptible to damage from long-term placement in the body.

With implanted devices and miniaturization becoming more common, there is an increasing need to provide electronic wiring and electronic connections in such systems that are both relatively simple and reliable.

Any discussion of documents, acts, materials, devices, articles or the like which has been included in the present specification is solely for the purpose of providing a context for the present invention. It is not to be taken as an admission that any or all of these matters form part of the prior art base or were common general knowledge in the field relevant to the present invention as it existed before the priority date of each claim of this application.

SUMMARY OF THE INVENTION

Throughout this specification the word "comprise", or variations such as "comprises" or "comprising", will be understood to imply the inclusion of a stated element, integer or step, or group of elements, integers or steps, but not the exclusion of any other element, integer or step, or group of elements, integers or steps.

In a first aspect, the present invention is a method of forming and connecting an antenna to a feedthrough member of a housing, the method comprising:

(a) positioning the feedthrough member and an antenna template relative to each other;

(b) connecting a first portion of at least one electrically conducting wire to said feedthrough;

(c) winding said wire at least once around the antenna template; and (d) connecting a second portion of each wire to said feedthrough member.

In this aspect, the steps can be performed in the order set out above. It will be appreciated that at least some of the steps could be performed in other orders or simultaneously. For example, step (c) could be performed prior to or at the same time as step (b) or step (a), Still further, step (d) could be performed prior to the other steps.

In this aspect, step (a) can include removably mounting the feedthrough member to a workspace member. In one embodiment, tile antenna template can also be removably or non-removably mounted to this workspace member. In another embodiment, the antenna template can be an integral component of the workspace member.

In yet another embodiment, the feedthrough member can comprise a first portion and a second portion, the first and second portions being mountable or mounted in the chassis of the housing. Respective conductive posts can extend through these portions and are all are preferably electrically insulated from each other. The feedthrough member is adapted to provide electrical connection through the chassis or wall of the housing whilst also ensuring hermetic sealing of the housing.

In one embodiment, step (b) can comprise connecting the wire to the first portion of the feedthrough member and step (d) can comprise connecting the wire to the second portion of the feedthrough member. In an alternative embodiment, step (b) can comprise connecting the wire to the second portion of the feedthrough member and step (d) can comprise connecting the wire to the first portion of the feedthrough member.

The wire can be connected to the feedthrough member using a wire bonder. Alternative techniques may be utilized including welding and crimping.

In a further embodiment, the first portion of the wire can comprise an end of the wire. It will be appreciated that the connection could be made at a location away from the end of the wire. In this case, however, it is envisaged that the wire would then be trimmed.

In yet another embodiment, the step of connecting the second portion of the wire to the feedthrough member (i.e. step (d)) can be made at a location along the wire that is distal from the first portion. In this case, however, it is envisaged that the wire would then be tied at the location of the connection to the feedthrough member. Despite the connection of the second portion of the wire being at a distal location along the wire, it will be appreciated that the second portion and first portion of the feedthrough member can be relatively close to each other.

In one embodiment, more than one wire can be connected to the feedthrough member and wound around the antenna template including, for example, a multistrand wire. In this or another embodiment, the wire can be wound around the antenna template more than one time. For example, the wire can be wound around the template twice.

The wire can be formed from a biocompatible electrically conductive material. In a preferred embodiment, the wire is formed from a suitable metal or metal alloy. In one embodiment, the wire can be formed from platinum or platinum/iridium alloy. In one embodiment, the wire is circular in cross-section. Other shapes of wire are envisaged, including wires that are oval in cross-section, or are foil-like having a width greater than its thickness.

In one embodiment, the wire can be coated with an electrically insulating material, such as a polymer material. In one embodiment, the electical connection formed between the wire and the feedthrough member can be performed through the insulating layer.

In another embodiment, the wire can be uncoated when electrically connected to die feedthrough member. In this case, it is envisaged that the antenna formed by the method according to the first aspect would undergo a coating step where at least the wire is encapsulated in an electrically insulating material.

For example, the antenna could be passed through a parylene coater so as to coat at least parts of the antenna with a suitable layer of parylene. In this case, it is envisaged that, if necessary, certain parts of the feedthrough would be masked to prevent their coating with parylene.

At the completion of step (d), the formed antenna and the feedthrough can be removed from the workspace member.

In one embodiment, the method can further include the step of encapsulating the housing, feedthrough and antenna in an electrically insulating material. This material is further also preferably biocompatible and resiliently flexible. One example of a possible encapsulating material is silicone. If desired, the formed device can undergo further processing, including washing and drying, to render it suitable for implantation.

The antenna template can comprise a cylinder. As such, the wound wire can define a circular locus. It will be appreciated that other shapes might be stable and could be utilized to form the antenna.

The formed antenna can comprise a receiver antenna. The method has potential advantages in providing a relatively efficient and inexpensive process of antenna manufacture, particularly assembly of receiver antennae for implantable tissue-stimulating devices, such as cochlear implants. The present invention further provides a method of forming an antenna that can allow the manufacturing process to become automated or semi-automated so providing a desirable alternative to current manufacturing processes which require, extensive labor input and increased manufacturing throughput.

According to a second aspect, the present invention is an antenna and feedthrough member assembly when formed by the method as defined herein.

In one embodiment of this aspect the antenna n be a receiver antenna. The antenna and feedthrough assembly can be suitable for use in tissue-stimulating and sensor applications or otherwise as described herein.

According to a third aspect, the present invention is a method of forming a non-linear path of at least a portion of at least one electrically conducting wire extending between a first location and a second location, the method comprising:

(a) forming a wire path template defining a non-linear path; and (b) winding said wire through said template such that said wire adopts said non-linear path; and (c) removing the wire from said template.

As used below, it will be appreciated that the term "wire" can encompass a plurality of wires including, for example, a multistrand wire.

In one embodiment, the wire path template can be removably or non-removably mounted to a workspace member. In another embodiment, the wire path template can be an integral component of the workspace member.

In another embodiment of the third aspect, a feedthrough member of a housing can be removably mounted to die workspace member. In this embodiment, the feedthrough member can comprise the first location. Where the feedthrough is present, the method can comprise a step of connecting the wire to the feedthrough member. In one embodiment, an end of the wire can be connected to the feedthrough member. It will be appreciated that the connection could be made at a location away from the end of the wire. In this case, however, it is envisaged that the wire would then be trimmed.

In one embodiment, the wire path template is adapted to form an undulating wire path over said portion of the wire. For example, the formed wire path can be sinusoidal or substantially so. In this embodiment the wire path template can comprise a series of spaced posts that define the path and about which the wire is to be wound.

In one embodiment, the wire can be adapted to provide electrical connection to one or more electrodes. In one embodiment, the wire can provide electrical connection to one or more extracochlear electrodes. In another embodiment the wire can provide electrical connection to one or more intracochlear electrodes.

The non-linear path of said portion of the wire provides a degree of flexibility to the wire following implantation. For example, the nonlinear path can be adapted to compensate for any movement between the housing and the one or more electrodes, such as movement which may occur naturally due to body growth.

The wire can be connected to the feedthrough member using a wire bonder. The wire bonder can also be utilized to wind the wire through the path of the wire path template. Alternative connection techniques can be envisaged including welding and crimping.

In this aspect the wire can be formed from a biocompatible electrically conductive material. In a preferred embodiment the wire is formed from a suitable metal or metal alloy. In one embodiment, the wire can be formed from platinum or platinum/iridium alloy. In one embodiment the wire is circular in cross-section. Other shapes of wire are envisaged, including wires that are oval in cross-section, or are foil-like having a width greater than its thickness.

In one embodiment, tie wire can be coated wit an electrically insulating material, such as a polymer material. In one embodiment the electrical connection formed between the wire and the feedthrough member can be performed through the insulating layer.

In another embodiment the wire can be uncoated when electrically connected to the feedthrough member. In this case, it is envisaged that the wire formed by the method according to the first aspect would undergo a coating step where the wire is encapsulated in an electrically insulating material.

For example, the wire could be passed through a parylene coater so as to coat at least parts of the antenna with a suitable layer of parylene. In this case, it is envisaged that, if necessary, certain parts of tie feedthrough would be masked to prevent their coating with parylene.

In of the embodiment of this aspect, the method can further include the step of encapsulating the housing, feedthrough and at least some of tie wire in an electrically insulating material. This material is further also preferably biocompatible and resiliently flexible. One example of a possible encapsulating material is silicone. If desired, the formed device can undergo further processing, including washing and drying, to render it suitable for implantation.

According to a fourth aspect, the present invention is a wire having a portion thereof defining a non-linear path when formed by the method as defined herein according to the third aspect of the invention.

In a preferred embodiment, the antenna and/or wire as defined herein are for use as an implantable tissue-stimulating device. More preferably, the tissue-stimulating device is a cochlear electrode assembly, including an intracochlear electrode assembly. In another embodiment, the electrode array could be used in a biosensor not necessarily related to an implanted device.

In this case, the feedthrough member provides electrical connection through the wall of an implantable component, such as a receiver/stimulator unit.

In a fifth aspect, the present invention is a method of forming a device comprised of a predetermined pattern of at least two relatively electrically conductive regions, the method comprising:

(a) working a sheet of electrically conductive material to remove predetermined portions therefrom to form said two or more discrete relatively conducting regions;

(b) connecting at least one electrically conducting wire to at least one of said at least two or more relatively conducting regions; and (c) connecting a portion of each wire located distal said conducting regions to a common sacrificial member.

In this fifth aspect, the steps can be performed in the order set out above. It will be appreciated that at least some of the steps could be performed in other orders or simultaneously. For example, step (c) could be performed prior to or at the same time as step (b) or step (a).

In this fifth aspect, the step of working the sheet (i.e. step (a)) can include a step of punching portions out of the sheet of electrically conductive material. In this embodiment, portions of the sheet are removed and separated from the sheet.

Yet further, the step of working the sheet can include a step of slicing or cutting the sheet of electrically conductive material.

In yet another embodiment of this aspect, the step of working the sheet can comprise a process of using electrical discharge machining (EDM), which is also known as spark erosion, to remove unwanted portions of the sheet as is described in the present applicant's International Publication No WO 02/089907, the contents of which are incorporated herein by reference.

In a further embodiment of this aspect, the step of connecting the wires (i.e. step (b)) can comprise a step of welding each wire to a respective relatively conducting region. In one embodiment, a distal end of the wire is welded to the conducting region. It will be appreciated that the connection could be made at a location away from the end of the wire. In this case, however, it is envisaged that the wire would then be trimmed.

In yet another embodiment of this aspect the step of connecting a proximal portion of the wire to a sacrificial member (i.e. step (c)) can comprise a step of welding each wire to the sacrificial member. In one embodiment, a proximal end of the wire is welded to the sacrificial member. It will be appreciated that the connection could be made at a location away from the proximal end of the wire. In this case, however, it is envisaged that the wire would en be trimmed at the location of the weld.

In one embodiment of this aspect, each of the, wires can be individually welded to their respective conductive region and the sacrificial member. In another embodiment, two or more wires can be welded simultaneously, at one or both locations. In another embodiment, all of the wires can be welded simultaneously, at one or both locations. In a further embodiment, the welding can be performed manually. In a preferred embodiment, an automatic welding maze can be used to weld the wires to the conductive regions and the sacrificial member.

It is preferred that the wires are welded to the sacrificial member in a manner that allows ready identification as to which conductive region the wire is extending from. For example, the proximal ends of the wires can be aligned transversely along the sacrificial member. For example, where there are a plurality of conductive regions disposed in a longitudinal array and the same number of wires extending therefrom, the wire extending from the region that is most distal the sacrificial member can be at one end of the member, the wire from the next most distal region beside it, and so on until each of the wires are electrically connected, such as by welding, to the sacrificial member.

This ordering of the connection of the wires to the sacrificial member results in there being no need to retest which wire is connected to which conductive region at a later date in a manufacturing process that uses the device according to the fifth aspect. Instead, it is possible by noting the location of ate weld of the wire to the sacrificial member to determine which conductive region that wire is extending from.

The wire can be formed from a biocompatible electrically conductive material. In a preferred embodiment, the wire is formed from a suitable metal or metal alloy. In one embodiment, the wire can be formed from platinum or platinum/iridium alloy. In one embodiment, the wire is circular in cross-section. Other shapes of wire are envisaged, including wires that are oval in cross-section, or are foil-like having a width greater than its thickness.

In one embodiment, the wire can be coated with an electrically insulating material, such as a polymer material. In one embodiment, the electrical connection formed between the wire and the conductive region and/or sacrificial member, such as the formation of a weld, can be performed through the insulating layer.

In another embodiment of the fifth aspect, the wire can be uncoated when electrically connected to the conductive region and/or sacrificial member. In this case, it is envisaged that the device formed by the method according to the fifth aspect would undergo a coating step where at least the wires are encapsulated in an electrically insulating material.

For example, the device could be passed through a parylene coater so as to coat at least parts of the device with a suitable layer of parylene. In this case, it is envisaged that the electrically conductive regions would be masked to prevent their coating with parylene.

In one embodiment, the method can further include the step of encapsulating the device in an electrically insulating material. This material is further also preferably biocompatible and resiliently flexible. One example of a possible encapsulating material is silicone. The result is preferably a plurality of separate electrically independent conductive portions having a layer of silicone encapsulated on one side thereof. If desired, the formed device can undergo further processing, including washing and drying, to reader it suitable for implantation.

In one embodiment, the sacrificial member is in the form of a plate. The sacrificial member as its name implies is adapted to be sacrificed when the device made by the method cording to the fifth aspect is ready to be utilized for the purpose for which it was manufactured. In one embodiment, the plate is preferably formed from a suitable metal to allow welding of the distal ends of the wires to the plate.

In a preferred embodiment, the device formed by the method according to the fifth aspect is preferably an electrode array for an electrode assembly. The method has potential advantages in providing a relatively efficient and inexpensive process of electrode assembly manufacture, particularly assembly of intracochlear electrode assemblies. The present invention further provides a method of forming an electrode array for an electrode assembly that preferably allows the manufacturing process to become automated or semi-automated so providing a desirable alternative to current manufacturing processes which require extensive labor input and increased manufacturing throughput.

In a preferred embodiment the electrode array is for use as an implantable tissue-stimulating device. More preferably, the tissue-stimulating device is a cochlear electrode assembly, more preferably an intracochlear electrode assembly. In another embodiment, the electrode array could be used in a biosensor not necessarily related to an implanted device.

In this embodiment tile electrically conductive regions formed in step (a) comprise the plurality of stimulating pads or electrodes of the array. The wires are welded to these electrodes and extend therefrom to a sacrificial plate. The wires remain welded to the plate until such time as the array is required for the manufacturing process in which the wires are connected to a feedthrough device that provides electrical connection through the wall of an implantable component such as a receiver/stimulator unit. In this regard, the wires can be out away from the plate when connection needs to be made to the feedthrough. The plate can then be disposed of or re-used.

In one embodiment of the fifth aspect, the sheet of electrically conductive material worked in step (a) is a biocompatible material. In a preferred embodiment, the sheet is a metallic material. Still further, the metallic material is a sheet of platinum. In a further embodiment the sheet can be annealed. In a further embodiment each of the electrodes is fouled from a single sheet of electrically conductive material, such as platinum. In a further embodiment, more than one array can be formed from a single sheet of platinum. In yet a further embodiment, the sheet could be a laminate of two or more layers (eg Pt & Ir), or could be an alloy.

The sheet preferably has a thickness between about 10 and 200 microns, more preferably between about 20 and 100 microns. The method preferably uses a sheet of platinum having a thickness of around 50 microns. Other suitable thicknesses can be envisaged, Each sheet can have dimensions of about 50 mm=250 mm. The size of the sheet will though depend on the requirements of the tooling used to work the sheet. As such, sheets of different dimensions can be envisaged.

The wires are preferably linearly aligned for at least a majority, and preferably all, of their length extending away from the electrode array. In one embodiment, the wires ran be disposed for at least a portion of their lengths in a parallel arrangement.

The sheet of conductive material can, before the working step, be a planar sheet. Sheets that already have folds or embossments formed therein prior to the working step of the present invention can, however, also be envisaged.

In one embodiment, the step of working the sheet can further comprise deforming at least a portion of the planar sheet in a third dimension. For example, once a plurality of planar conductive electrodes are at least partially formed, they can be placed in a concave moulding die in which they are deformed to adopt a curved configuration. In one embodiment, this stop can occur prior to step (b). Where the electrodes have a curved configuration, the wires can be joined, such as by automatic welding, to the concave surfaces of the respective electrodes.

In one embodiment, the respective electrodes formed from a planar sheet can be substantially rectangular or rectangular. Other suitable shapes for the formed electrodes can, however, be envisaged. In one embodiment, the potions of the sheet removed from the sheet can be bone-shaped.

In producing an electrode array, it is firstly desirable to determine the configuration of the stimulating pads desired for the electrode array. Once the configuration is determined, the step of working the sheet cm comprise working the sheet, such as by using a punch that is fabricated for use in the method or other technique as defined herein, so as to produce the desired electrode array configuration.

Various techniques for punching, cutting, and otherwise working the sheet are also described in International Patent Publication No. WO 02/089907 already referenced herein.

In one embodiment, two or more arrays formed using the method can be laminated together to form a single tissue stimulating electrode assembly. In one embodiment, the assembly can be formed from a first lamination having 7 electrodes, a second lamination having 8 electrodes and a third lamination having 8 electrodes, to form an electrode assembly having 23 electrodes. In the case of a cochlear electrode array, the formed array will preferably have 22 intracochlear electrodes and one extracochlear electrode. Such a lamination process preferably results in a linear array of the 22 electrodes. It will be appreciated that other combinations of layers and other numbers of electrodes in each layer could be utilized to form arrays of different lengths, up to around 100 electrodes.

It will be appreciated that it is generally important that the lead which is comprised of the wires extending from the array to the feedthrough is capable of a degree of flexibility to compensate for any movement between the stimulator and the electrodes, such as movement which may naturally occur due to body growth. In one embodiment, the method can comprise a still further step of winding tie lead in a helical-manner. In one embodiment, the winding can result in the lead having a helical portion. The winding can be such that the wires extend over the same longitudinal extent in the helical portion. Techniques for forming the winding are described in the present applicants International Application No. PCT/AU03/01369; the contents of which are incorporated herein by reference.

According to a sixth aspect, the present invention is a device when formed by the method as defined herein comprising:

a predetermined pattern of at least two electrically conductive regions; and at least one wire extending from each of the conductive regions to a common sacrificial member.

In one embodiment of this sixth aspen the device is preferably an electrode array. The electrode array can be suitable for use in tissue-stimulating and sensor applications or otherwise as defined herein with reference to the fifth aspect of the invention.

According to a seventh aspect the present invention is a method of making an implantable electrode array, the method comprising:

(a) supporting a sheet of electrically conductive biocompatible material;

(b) working the sheet to remove one or more first portions therefrom;

(c) connecting at least one electrically conducting wire to said punched sheet using a bonding machine; and (d) working the sheet to remove one or more second portions therefrom to form two or more discrete relatively conducting regions.

In one embodiment of this aspect, the bonding machine is an automatic bonding machine. In this regard, the automatic bonding machine may be an automatic welding machine capable of performing ultrasonic or resistance welding.

Preferably, the sheet is no greater than around 200 microns thick.

Preferably, the working of the sheet in step (b) comprising punching the sheet.

Preferably, a portion of each wire is located distal said conducting regions to a common sacrificial member.

BRIEF DESCRIPTION OF THE DRAWINGS

By way of example only, preferred embodiments of the invention are now described with reference to the accompanying drawings, in which.

DETAILED DESCRIPTION

FIG. 1 depicts some of the steps of a method according to the present invention, depicted generally as 10, for forming an antenna and feed through assembly that is suitable for use in a tissue-stimulating device, such as a Cochlear™ implant (also referred to as Cochlear™ prostheses, Cochlear™ devices, and the like; for simplicity hereinafter referred to as "cochlear implant").

Figure 1A:
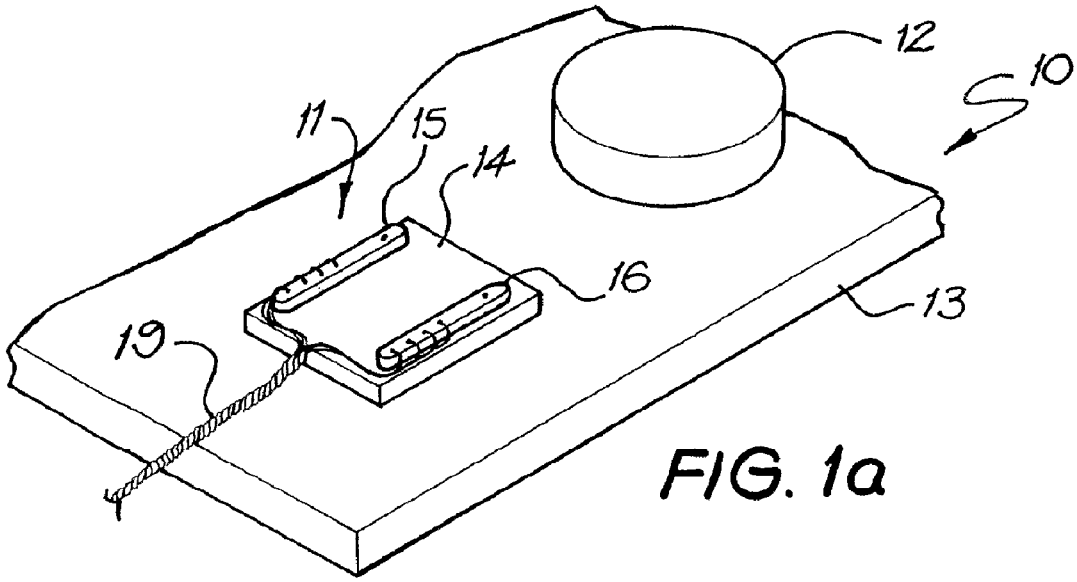
FIG. 1 depicts the steps of one embodiment of a method of forming an antenna connected to a feedthrough of a housing according to the present invention.

As depicted in FIG. 1*a*, a feedthrough member 11 and an antenna template 12 are mounted to a workspace member 13. The relative position of the member 11 and template 12 are based on the desired dimensions of the antenna to be formed.

In the depicted embodiment the feedthrough member 11 is mountable in a wall or chassis of a housing 14 and comprises a fist portion 15 and a second portion 16, Both of the portions 15,16 have a plurality of conductive posts extending through an electrically insulating block that hermetically seals the housing 14. In the depicted embodiment, the feedthrough member 11 is usable for both the wires feeding back from the electrodes (not depicted) of an intracochlear array and the wire or wires that will comprise the antenna coil.

Figure 1B:
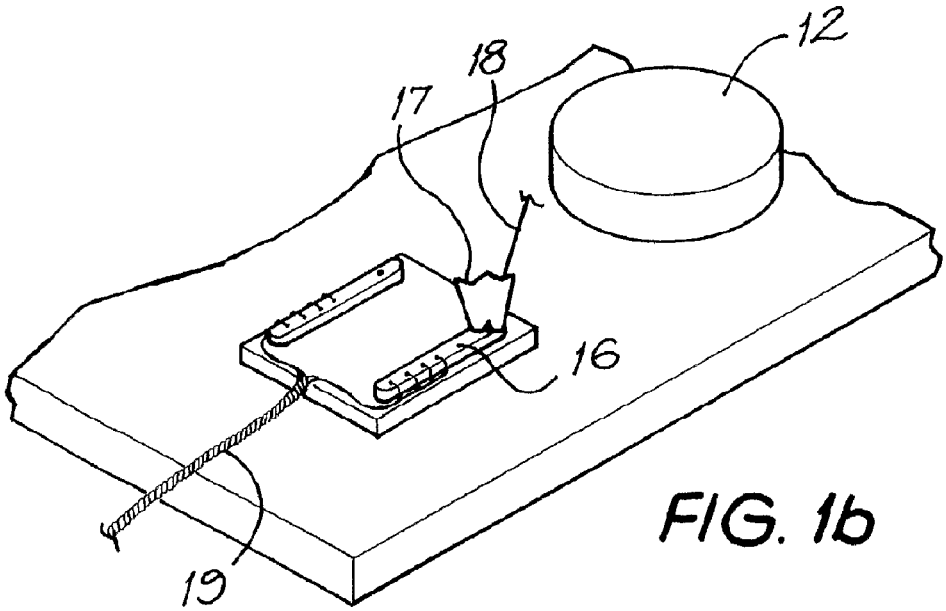

FIG. 1*b*, a wire bonder 17 is used to connect an end of the antenna wire 18 to a conductive post of the second portion 16 of the feedthrough member 11. The use of wire bonding enables both a mechanical and electrical connection to be achieved in a single operation.

Figure 1C:
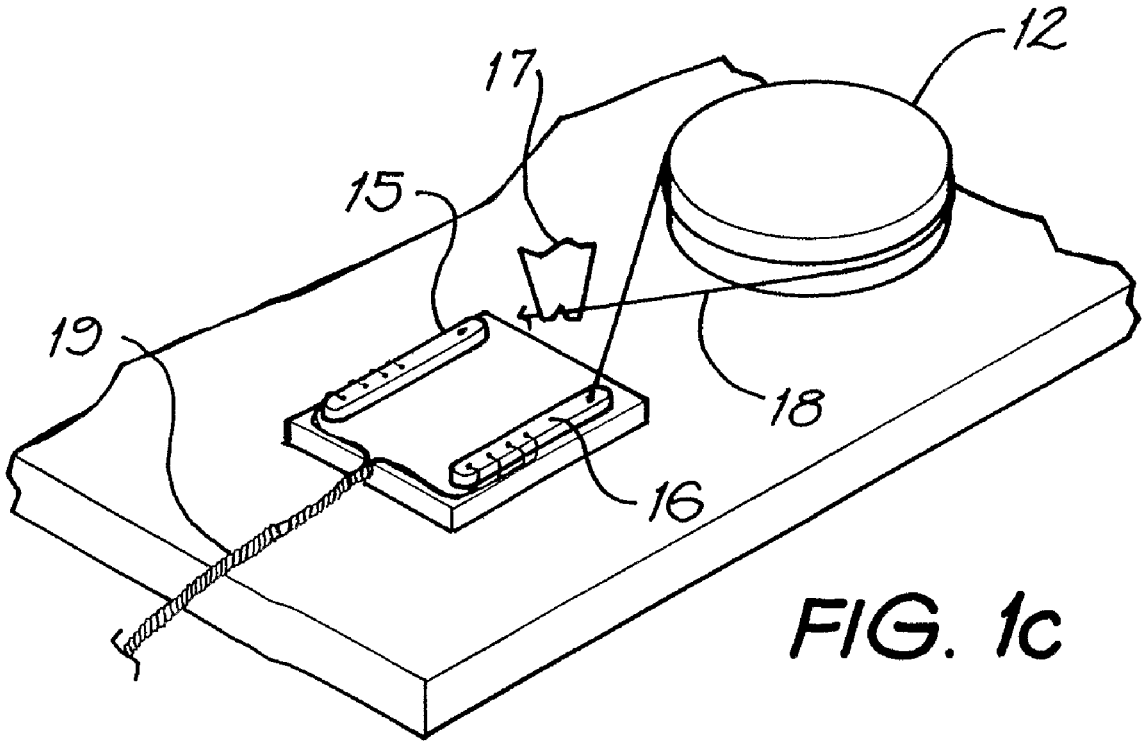
Figure 1D:
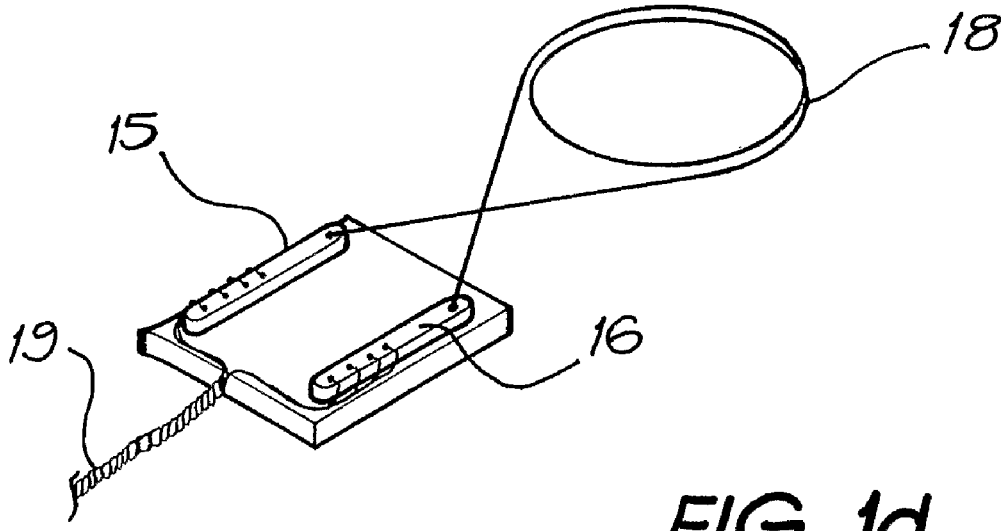

The wire bonder 17 is then used to wind the wire 18 around tile template 12 to form the antenna. As depicted in FIG. 1*c*, the wire 18 is wound around the template 12 to form the antenna coil before then bonding the outer end of the wire 18 to the first portion 15 of the feedthrough member 11 (as depicted in FIG. 1*d*). In the depicted embodiment, the antenna template 12 is cylindrical. It will be appreciated that other shapes might be suitable and could be utilized to form the windings of the antenna.

The wire 18 can be coated with an electrically insulating material, such as a polymer material such as parylene. A small area of the insulating material is removed at the end of the wire prior to the respective bondings to the feedthrough member 11. In the depicted embodiment, the wire 18 is formed from platinum or a platinum/iridium alloy and is circular in cross-section. Other shapes of wire are envisaged, including wires that are oval in cross-section or flat, ribbon-like.

Figure 2:
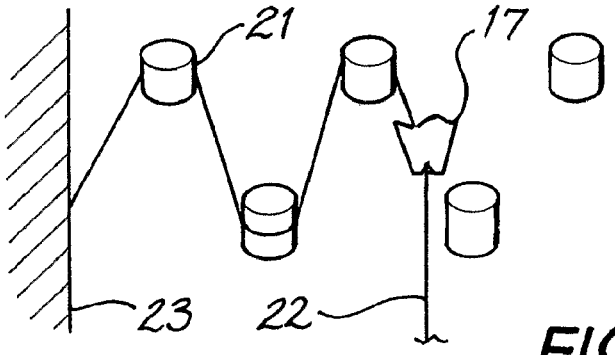
FIG. 2 depicts a wire path template for forming a non-linear wire path according to the present invention.

FIG. 2 depicts a method of forming a non-linear path of at least a portion of an electrically conducting wire, such as a wire extending from the feedthrough member 11 to one or more implantable electrodes (not shown).

In this example, the wire path template comprises a series of appropriately spaced posts 21 about which a wire 22 can be wound by a wire bonder 17. It is envisaged that the posts 21 would be mounted to a workspace member. In the depicted embodiment, an end of the wire is firstly bonded at a first location 23. Location 23 can be envisaged in one embodiment to be a feedthrough member, such as feedthrough member 11 depicted in FIGS. 1*a*-1*d*, with the formed non-linear wire being one of the wires 19 depicted in FIG. 1 that extends to one ore more electrodes.

Once the wire 22 has been wound between the posts, the wire can be removed from the workspace or remain in the workspace for further processing as required. Such further processing might include bonding of one or more electrodes to the wire and/or encapsulation of the wire in an appropriate encapsulant, such as a silicone.

Figure 3:
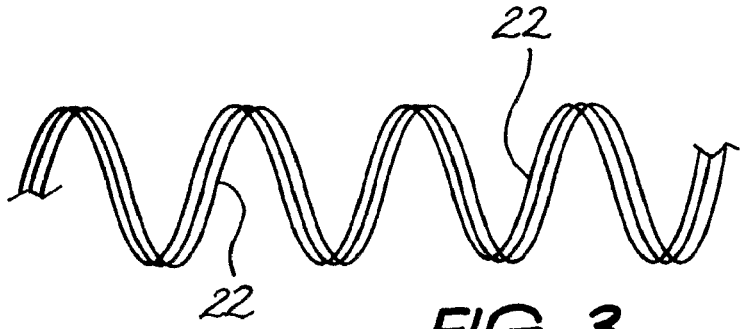
FIG. 3 depicts a wire having a portion having a non-linear path formed using the template of FIG. 2.

As depicted by FIG. 3, more than one wire 22 can be wound through the wire path template to font a multistrand electrically conducting lead.

As is the case for wire 18 depicted in FIGS. 1*a*-1*d*, the wire 22 is formed from platinum or a platinum/iridium alloy and is circular in cross-section. Other shapes of wire are envisaged, including wires tat are oval in cross-section.

The formed nonlinear path of at least a portion of the lead serves to assist in ensuring that the lead does not fail, following implantation, due to movement that may occur between the ends of the load, such as movement that may occur due to body growth of the implantee. The formed non-linear path is also useful in providing stain relief at the feedthrough connections to protect against damage during the manufacturing process.

Further processes according to embodiments of the present invention for the manufacture of an electrode array are depicted in FIGS. 4-8 of the drawings.

Figure 4:
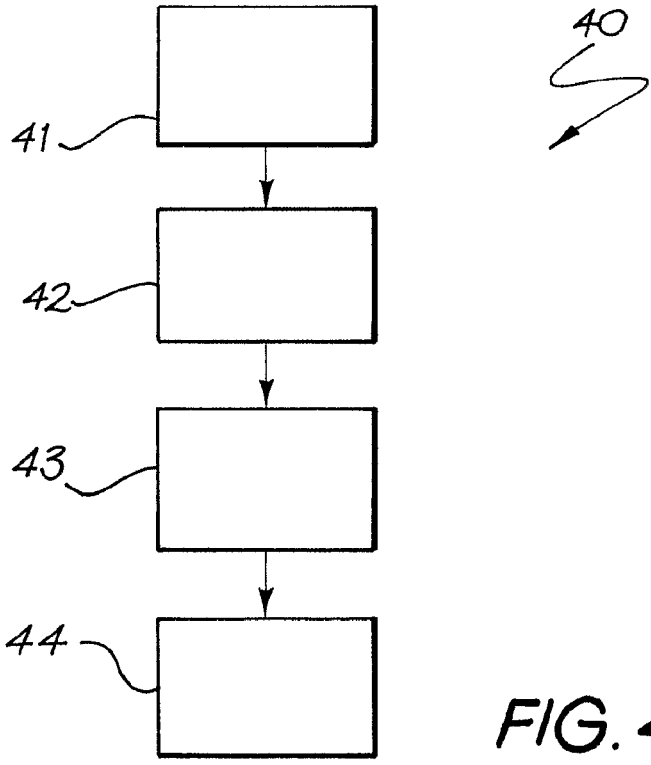
FIG. 4 is a flow chart depicting at least some of the steps of one embodiment of the method of forming an electrode array according to the present invention.

FIG. 4 is a flow chart of an example of some of the steps of a method according to the present invention, depicted generally as 40, for forming an electrode array that is suitable for use as a tissue-stimulating device within the human cochlea.

As depicted, the method 40 comprises a series of steps 41 to 44 which form the electrode array. In the depicted method 40, and with further reference to FIG. 5*a*, a platinum shed 53 is used as it is a biocompatible material and is a proven material for use in cochlear implants manufactured using traditional techniques. The sheet 53 is in the form of a foil and typically has a thickness of around 50 microns, although this can vary between about 10 and 200 microns.

In step 41 of the depicted method the platinum sheet 53 is firstly supported in a holder. The method 40 further comprises a step 42 in which an electrode array pattern is formed in the supported platinum sheet 53. In this example, the following step 42 comprises removing portions of the platinum sheet 53 therefrom such that at least the desired pattern of the electrode array remains. In the example, step 42 comprises a process of using a punch to punch out unwanted portions of the sheet 53.

Figure 5A:
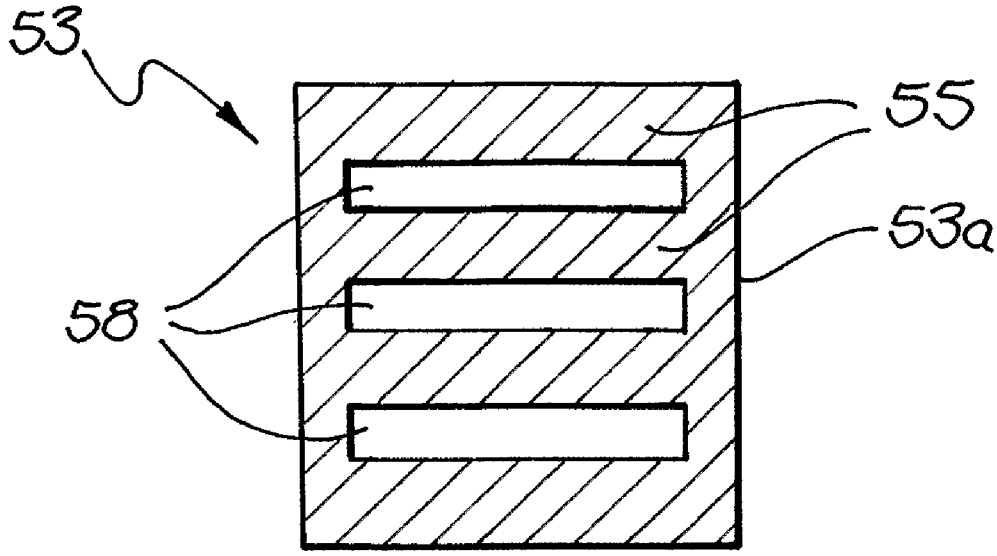
FIGS. 5*a* and 5*b* are a plan and perspective view of an electrode array formed in a platinum sheet.

As depicted in FIG. 5*a*, the punch can firstly remove rectangular portions 58 of the sheet 53 leaving a plurality of portions that will become the electrodes 55 of the array after later removing the outer portions 53*a* of the sheet 53 along the dotted lines shown in FIG. 5*b*. In the depicted embodiment the electrodes 55 formed in the sheet 53 have a size of about 0.4 $mm^2$-0.5 $mm^2$. While the electrodes 55 are depicted as rectangular in shape, it win be appreciated that the electrodes could be formed in different shapes by using a punch to remove non-rectangular portions from the sheet. For example, the punch can be adapted to remove bone-shaped portions.

Figure 5B:
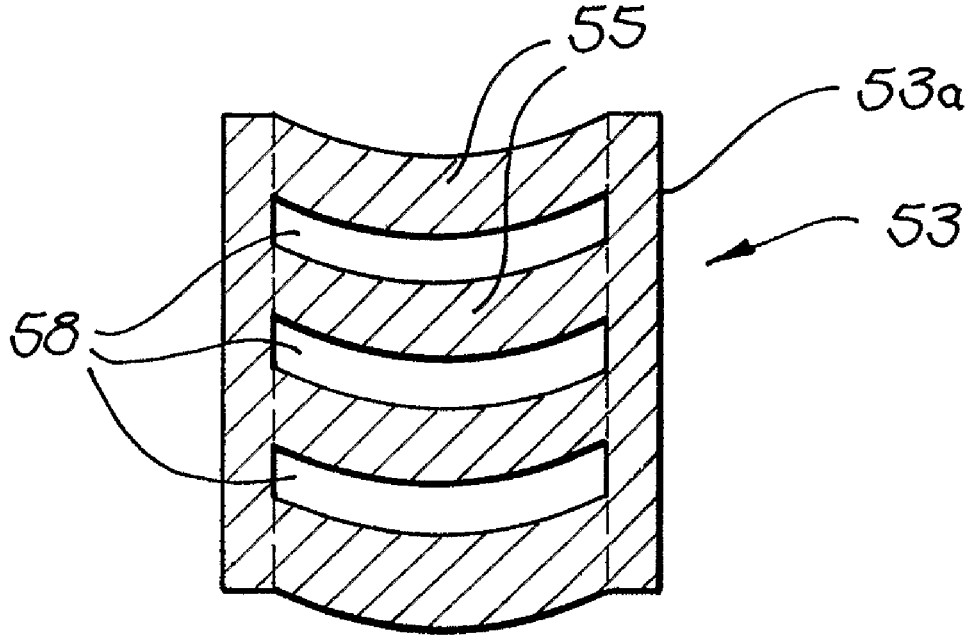

As depicted in FIG. 5*b*, the step 42 can further comprise a step of deforming the sheet 53 in a third dimension. In FIG. 5*b*, the electrodes 55 of the sheet have been deformed so as to adopt a curved configuration by being placed in a concave moulding die.

It will be appreciated that in step 42, those portions of the sheet 53 to be removed can be removed by other techniques, such as laser ablation, micro-knifing, milling, or electrode discharge machining to remove the unwanted portions 58 of the sheet 53.

Figure 6:
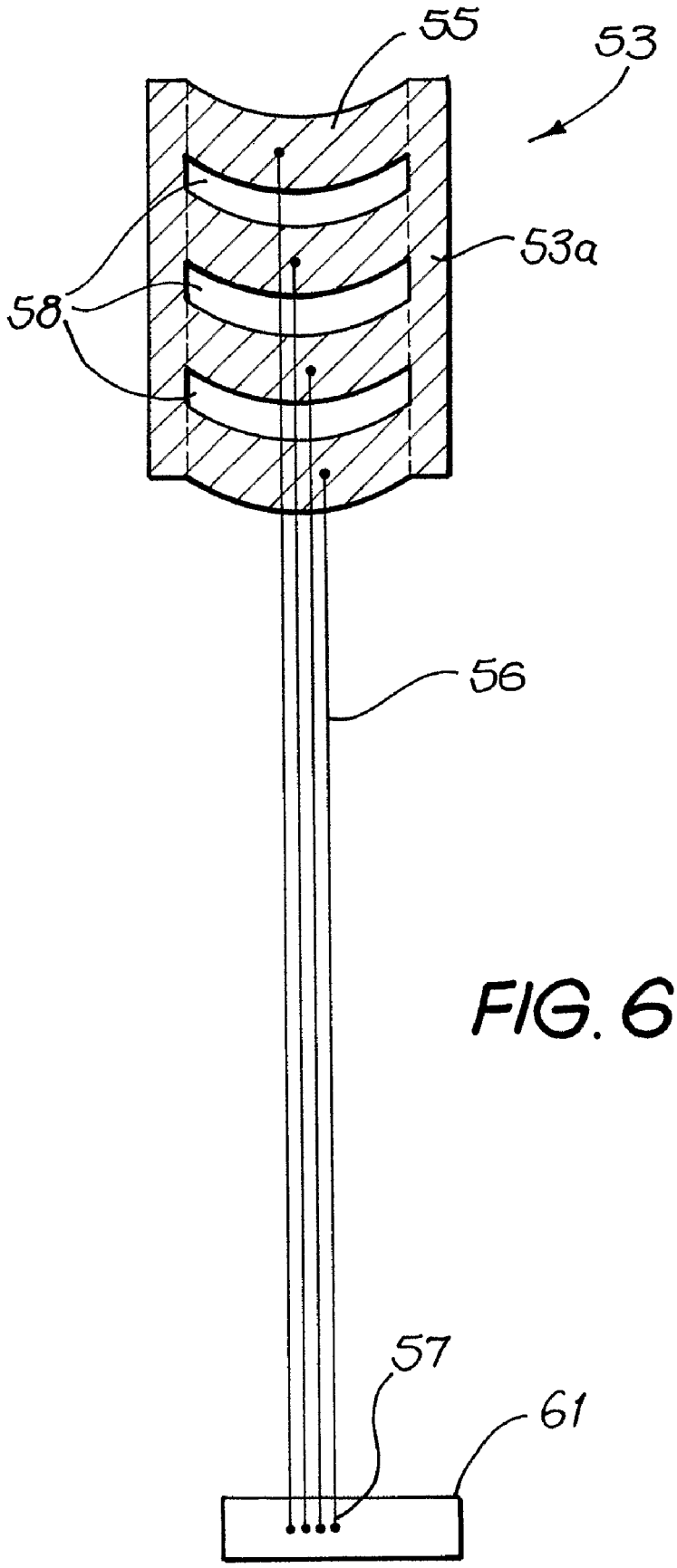
FIG. 6 depicts the electrode array of FIG. 5*b* following the welding of wires thereto.

Tile method 40 further comprises a step 43 of welding electrically conducting wires 56 to the concave faces of the electrodes 55 (see FIG. 6). The wire 56 can be coated with an electrically insulating material, such as a polymer material such as parylene. A small area of the insulating material is removed at the end of the wire prior to the welding step. This welding is performed by an automatic welding machine. Alternatively, this process can be performed using a wire bonding machine. In the depicted embodiment, the wires 56 are formed from platinum or a platinum/iridium alloy and are circular in cross-section. Other shapes of wire are envisaged, including wires that are oval in cross-section, or are foil-like having a width greater than its thickness.

The outer portions 53*a* of the sheet 53 serve to hold the sheet in the pattern formed during step 42 during subsequent processing steps.

Figure 7:
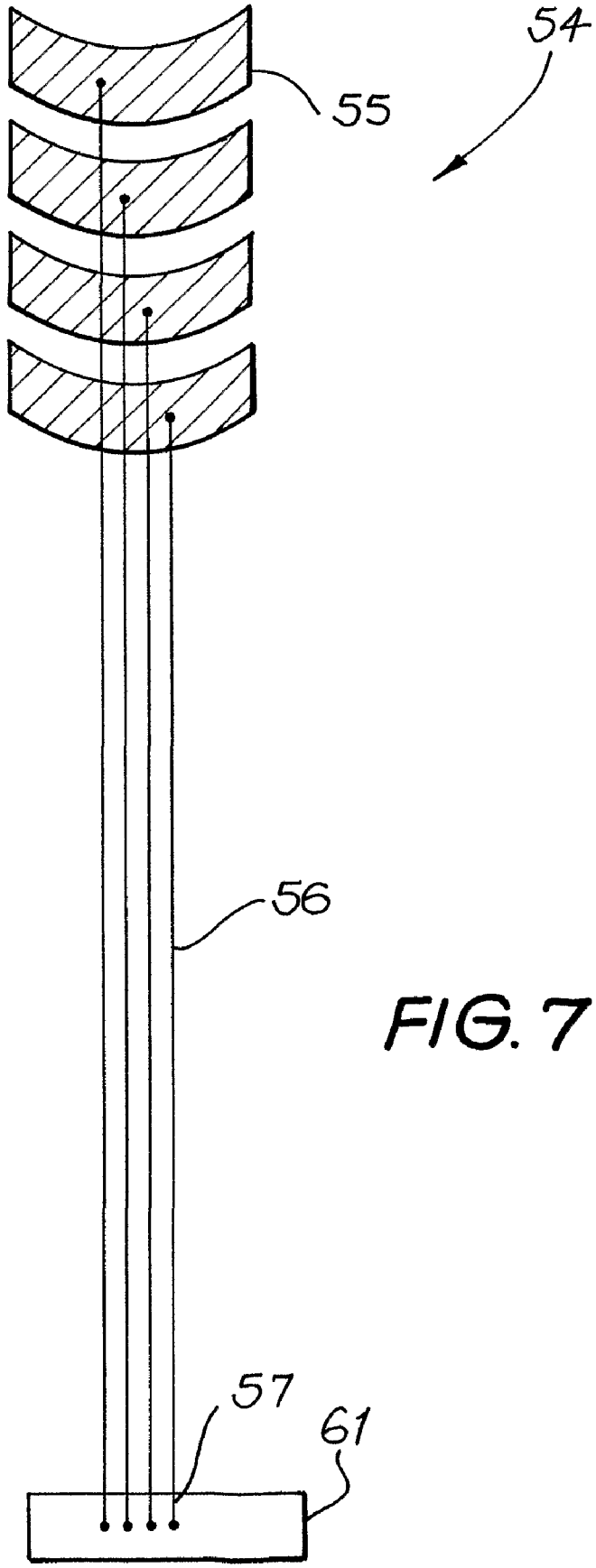
FIG. 7 depicts the electrode array of FIG. 6 following a flyer working step.

During step 44, the sheet 53 is preferably trimmed to remove the remaining portions 53*a* of the sheet that are not comprising the desired electrode array 54 (see FIG. 7). In the depicted example, the sheet 53 is trimmed with a knife. In another embodiment, a punch and die can be used to cut the electrode array from the remaining portions of the original sheet 53.

Each of the electrodes 55, and the corresponding welded wires 56, are formed in a manner such that their position with respect to each other is predetermined and kept constant throughout the process and in the final product.

To maintain this, step 43 can include a step where the proximal ends 57 of each of the wires are welded to a sacrificial plate 61 (see FIGS. 6 and 7). It will be appreciated that the connection to the plate 61 could be made at a location away from the proximal end 57 of the wire 56. In this case, however, it is envisaged that the wire 57 would then be trimmed at the location of the weld.

It will be appreciated that each of the wires 56 can be individually welded to their respective electrodes 55 and the sacrificial plate 61. It is, however, preferred that the wires 56 be welded at least substantially simultaneously, at one or both locations, by the automatic welding machine.

As depicted in FIGS. 6 and 7, the proximal ends 57 of the wires 56 can be aligned transversely along the sacrificial plate 61. As such, when there are a plurality of electrodes 55 disposed in a longitudinal array and the same number of wires 56 extending therefrom, the wire 56 extending from the electrode 55 that is most distal the sacrificial plate 61 can be at, near or closer to one end of the plate 61, the wire 56 from the next most distal electrode 55 beside it, and so on until each of the wires 56 are electrically connected to the sacrificial plate 61.

This ordering of the connection of the wires 56 to the sacrificial plate 61 results in there being no need to retest which wire 56 is connected to which conductive electrode 55 at a later date in the manufacturing process. Instead, it is possible by noting the location of the weld of the wire 56 to the sacrificial plate 61 to determine which electrode 55 that wire 56 is extending from.

The sacrificial plate 61 as its name implies is adapted to be sacrificed when the electrode array is ready to be electrically connected to a feedthrough device that provides electrical connection through the wall of an implantable component such as a receiver/stimulator unit of a cochlear implant. For example, the wires 56 can simply be cut from the plate 61 when the wires 56 are to be welded to the feedthrough.

Figure 8:
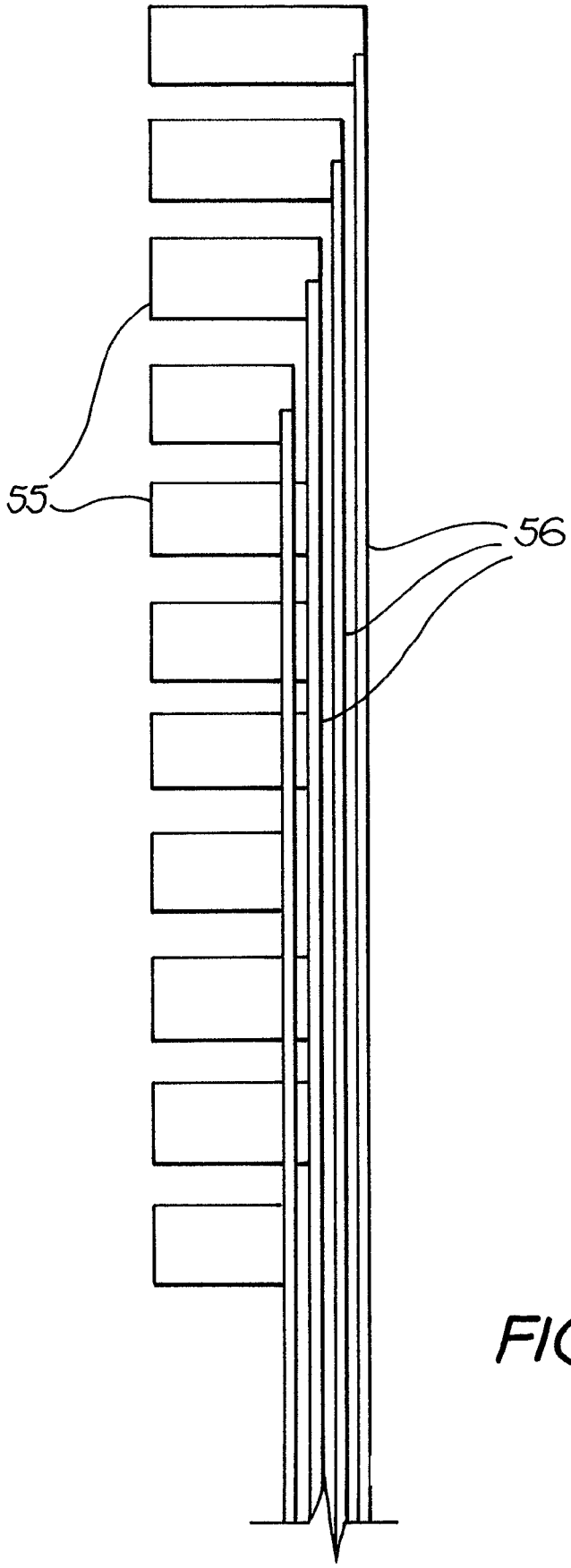
FIG. 8 depicts another embodiment of set of electrodes with wires that are welded thereto extending away therefrom.

It will be appreciated that a number of electrode sets with corresponding sacrificial plates as depicted in FIGS. 6 and 7 could be formed and stacked or laminated together and appropriately encapsulated to form a single tissue stimulating electrode assembly. One example of such an assembly is depicted by FIG. 8. In this embodiment the electrodes 55 are, however, still planar despite the wires 56 having been welded thereto.

In the case where the electrodes are still planar and as is described in International Publication No WO 02/089907, once the stack is formed, the hitherto at least substantially planar electrodes 55 can then be deformed so as to at least partially extend in a third dimension. In one embodiment, each of the electrodes is curved out of the plane of the, wires 56 for each set of electrodes. The curvature can be substantially semi-circular. A mandrel can be used to form the curvature in the electrodes.

Once the electrodes 55 have been deformed to have a substantially semi-circular curvature, each of the electrodes 55 can be further folded about a longitudinal axis of the array. This folding of the electrodes 55 serves to bend the electrodes around the wires 56 of the array. The electrodes are preferably folded together and define a lumen that extends through the array.

The lumen can act as a substance delivery means for delivering a bio-active substance to the implant site following implantation. Alternatively or additionally, the lumen cam receive a stylet to assist in insertion and placement of the array in the cochlea.

Embodiments of the present invention can be advantageously applied to make an entire assembly of components for an implantable medical device, such as a cochlear implant.

For example, a novel "skeleton" of various conductive components can be created within a single work procedure. A subsequent work procedure can then encapsulate the entire skeleton, or at least two components of the entire device.

This rearrangement of the work process steps, where the encapsulation is made in a single step, using a single curing system, helps to improve the integrity of the seal to prevent fluid ingress. This is especially important in implantable medical devices to reduce the risk of malfunction and infection. Traditionally, each one of the various components had been individually encapsulated, before being connected together.

The encapsulation step involves placing the components in a mould, which is then filled with a biocompatible silicone material. Silastic MDX 4-4210 is an example of one suitable silicone. In the case of the electrode array, the silicon forms an electrode carrier member, although the electrodes are preferably positioned in the mould so as to not be coated with the silicone.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A method of forming an antenna configured to be implanted in a recipient, comprising:

positioning a feedthrough member relative to an antenna template, wherein the feedthrough member is configured to provide an electrical connection through a wall of an implantable component implantable in the recipient along with the antenna;

connecting a first portion of at least one electrically conducting wire to the feedthrough member;

winding the at least one wire at least once around the antenna template; and connecting a second portion of the at least one wire to the feedthrough member.

2. The method according to claim 1, wherein the positioning the feedthrough member relative to the antenna template comprises:

mounting the feedthrough member to a workspace member in such a manner that the feedthrough member is later removable from the workspace member.

3. The method according to claim 2, further comprising:

removing the feedthrough member and the at least one wire from the workspace member following connecting the second portion of the at least one wire to the feedthrough member.

4. The method according to claim 3, further comprising:

encapsulating the housing, feedthrough member and at least one wire in an electrically insulating material.

5. The method according to claim 1, wherein the antenna template comprises a cylinder.

6. The method according to claim 1, wherein the feedthrough member comprises:

first and second feedthrough member portions each configured to be mounted on one of either a chassis and wall of a housing of an implantable component.

7. The method according to claim 6, wherein each of the first or second feedthrough member portions have at least one conductive post extending therethrough.

8. The method according to claim 1, further comprising mounting the feedthrough member on a wall of a housing of the implantable component.

9. The method according to claim 8, wherein the action of mounting the feedthrough member on the wall of the housing includes providing a hermetically sealed electrical connection through the wall of the housing of the implantable component.

10. The method according to claim 1, wherein the first portion of the at least one wire comprises an end of the wire.

11. The method according to claim 1, wherein the second portion of the at least one wire comprises a location along the wire that is distal from the first portion of the at least one wire.

12. The method according to claim 1, wherein the at least one wire comprises a plurality of wires.

13. The method of claim 1, further comprising removing the at least one wire from the antenna template after winding the at least one wire at least once around the antenna template.

14. The method according to claim 1, wherein the at least one wire is formed from a biocompatible electrically conductive material.

15. The method according to claim 1, wherein the at least one wire is coated with an electrically insulating material.

16. The method of claim 1, wherein the feedthrough member is configured to provide a hermetically sealed electrical connection through a housing of the an implantable component.

17. A method of forming an antenna configured to be implanted in a recipient, comprising:

obtaining a feedthrough member configured to provide a hermetically sealed electrical connection through a housing of an implantable component implantable in the recipient along with the antenna;

positioning the feedthrough member relative to an antenna template;

connecting a first portion of at least one electrically conducting wire to the feedthrough member;

winding the at least one wire at least once around the antenna template; and connecting a second portion of the at least one wire to the feedthrough member.

18. The method according to claim 17, further comprising mounting the feedthrough member on a wall of the housing of the implantable component.

19. The method according to claim 18, wherein the action of mounting the feedthrough member on the wall of the housing includes providing the hermetically sealed electrical connection through the wall of the housing of the implantable component.

20. The method of claim 17, further comprising removing the at least one wire from the antenna template after winding the at least one wire at least once around the antenna template.

21. A method of forming an antenna configured to be implanted in a recipient, comprising:

positioning a feedthrough member relative to an antenna template;

connecting a first portion of at least one electrically conducting wire to the feedthrough member;

winding the at least one wire at least once around the antenna template;

connecting a second portion of the at least one wire to the feedthrough member; and removing the at least one wire from the antenna template after winding the at least one wire at least once around the antenna template.

22. The method according to claim 21, further comprising mounting the feedthrough member on a wall of a housing of an implantable component implantable in the recipient along with the antenna.

23. The method according to claim 22, wherein the action of mounting the feedthrough member on the wall of the housing includes providing the hermetically sealed electrical connection through the wall of the housing of the implantable component.

* * * * *